United States Patent [19]

Frehn

[11] 3,942,954

[45] *Mar. 9, 1976

[54] SINTERING STEEL-BONDED CARBIDE HARD ALLOY

[75] Inventor: Fritz Frehn, Krefeld, Germany

[73] Assignee: Deutsche Edelstahlwerke Aktiengesellschaft, Krefeld, Germany

[ * ] Notice: The portion of the term of this patent subsequent to Apr. 30, 1985, has been disclaimed.

[22] Filed: Dec. 31, 1970

[21] Appl. No.: 103,312

[30] Foreign Application Priority Data

| | | |
|---|---|---|
| Dec. 2, 1970 | Germany | 2059251 |
| Jan. 5, 1970 | Germany | 2000257 |
| Feb. 21, 1970 | Germany | 2008197 |

[52] U.S. Cl. ..... 29/182.7; 29/182.8; 75/126 R; 75/126 A; 75/126 B; 75/126 C; 75/126 E; 75/126 F; 75/126 H; 75/126 P; 75/128 R; 75/128 A; 75/128 B; 75/128 G; 75/128 W; 148/126

[51] Int. Cl.[2] ..... C22C 1/05; C22C 29/00

[58] Field of Search ..... 29/182.7, 182.8; 75/126 R, 75/126 E, 128 R, 128 A, 128 B, 128 F, 128 G, 128 W, 126 A, 126 B, 126 C, 12 E, 126 F, 126 H, 126 P; 148/126

[56] References Cited

UNITED STATES PATENTS

| | | | |
|---|---|---|---|
| 2,507,195 | 5/1950 | Colbeck et al. | 29/182.8 X |
| 2,793,113 | 5/1957 | Rait et al. | 75/126 E X |
| 2,848,323 | 8/1958 | Harris et al. | 75/126 E X |
| 3,053,706 | 9/1962 | Gregory et al. | 29/182.7 X |
| 3,152,934 | 10/1964 | Lula et al. | 75/128 R X |
| 3,380,861 | 4/1968 | Frehn | 29/182.8 X |
| 3,390,967 | 7/1968 | Frehn | 29/182.8 X |
| 3,450,511 | 6/1969 | Frehn | 29/182.8 |
| 3,492,101 | 1/1970 | Prill et al. | 29/182.7 |

*Primary Examiner*—Leland A. Sebastian
*Assistant Examiner*—R. E. Schafer
*Attorney, Agent, or Firm*—Cushman, Darby & Cushman

[57] ABSTRACT

A sintered alloy comprising a carbide of preferably titanium and a steel matrix of an alloy steel containing chromium, molybdenum, copper and vanadium as alloying elements provide high temperature hardness and wear resistance. Preferred alloys contain 0.8 to 1.9% by weight of manganese and up to 80% by weight of carbide.

7 Claims, No Drawings

SINTERING STEEL-BONDED CARBIDE HARD ALLOY

This invention relates to carbide hard alloys, and to sintered parts made of such alloys.

A considerable number of compositions for sintered steel-bonded carbide hard alloys have previously been proposed. Such alloys substantially consist of approximately 10 to 70% by weight of a metal carbide or of a mixed carbide and from 30 to 90% by weight of a steel alloy. The steel matrix may in conventional manner consist of a ferritic, austenitic or martensitic unalloyed or alloyed steel. The steel matrix confers upon such carbide hard alloys the advantage compared with other hard metal alloys, of being hardenable after they have been sintered and machined. By contrast, conventional hard metals possess their final hardness when they have been sintered, and this hardness must be relatively low if subsequent machining is to be possible. Carbide hard alloys based on a steel matrix are not subject to this limitation because they need not be hardened to their final hardness until after they have been machined.

Depending on the intended use, carbide hard alloys contain various proportions of carbide and a steel matrix adapted to the desired end use.

It is the object of the present invention to provide a material of high wear resistance and hardness at high temperatures suitable for instance for making liners for tools used for flow forming, particularly hot forming. Such a material is moreover useful for high-speed parts for use in the construction of engines. Tool steels, i.e. hot and cold working steels, frequently lack the necessary hardness and abrasion resistance when hot, and this has an adverse effect on the life of parts made of such steels.

For satisfying the said requirements the invention provides a sintered steel-bonded carbide hard alloy containing 15 % to 80 % by weight of a carbide of the metals chromium, molybdenum, tungsten, tantalum, niobium, zirconium, preferably titanium, or a mixture of two or more thereof; and from 20 % to 85 % by weight of a steel consisting essentially of 0.25 to 0.9 % carbon,
5 to 18.0 % chromium,
2 to 5.0 % molybdenum,
0.3 to 3.0 % copper,
0.1 to 1.0 % vanadium,
0 to 3.0 % manganese,
0 to 1.0 % silicon,
0 to 6.0 % cobalt,
0 to 0.5 % niobium,
0 to 0.01 % boron,
0 to 1.8 % nickel,
balance iron.

By the term "consisting essentially of" is meant that impurities and incidental ingredients may be present in small proportions which do not significantly affect the stated characteristics.

A preferred carbide hard alloy according to the invention contains 32 % to 35 % by weight of titanium carbide and 65 % to 68 % by weight of a steel consisting essentially of 0.4 to 0.6 % carbon,
8.0 to 12.0 % chromium,
2.5 to 4.0 % molybdenum,
0.3 to 0.8 % copper,
0.001 to 0.01 % boron, 0.1 to 0.3 % vanadium,
0.1 to 0.3 % niobium,
balance iron A carbide hard alloy according to the invention satisfies requirements relating to high wear resistance and hardness, and is therefore a particularly suitable material for the production of liners for hot forming tools. Such liners are shrunk into a steel jacket at the highest temperature admissible for hot working steels, namely about 650°C. This operation must be carried out without substantial loss of hardness. At the same time the liner must be located in the working tool with a given degree of initial strain. This means that the material must be capable of sustaining the relatively high strain needed for insertion in the tool, and in service it must also be capable of withstanding the changing compressive and tensile loads without fracturing. These demands are also met by the carbide hard alloy according to the invention.

The said carbide hard alloy is also suitable for minor parts subject to wear that are produced in large numbers, that can be machined in the heat-treated condition, hardened to high wear-resisting hardness without distortion and scaling by a simple thermal treatment.

A preferred feature of the alloys according to the invention is that such parts can be produced to provide great dimensional stability, if 0.8 to 1.9 % of manganese are added to the steel matrix. Shapes can then be produced to very tight tolerations requiring only a slight finishing treatment by grinding away the very fine filmlike sinter skin.

A preferred carbide hard alloy according to the invention contains 32 % to 35 % by weight of titanium carbide and 65 % to 68 % by weight of a steel consisting essentially of 0.4 to 0.6 % carbon,
0.9 to 1.2 % manganese,
0.9 to 1.2 % copper,
0.1 to 0.5 % vanadium,
8.0 to 12.0 % chromium,
2.5 to 4.0 % molybdenum,
0.1 to 0.25 % niobium,
0.008 to 0.01 % boron,
balance iron Alloys according to the invention are prepared by mixing the powdered components in grain sizes up to 10 $\mu$m. Instead of the individual components, key alloys may, or in some instances should, be used, for example ferro-manganese, iron-aluminium and iron-boron. The mixture may be dry mixed for 30 minutes in a paddle blade mixer and then wet-mixed for 180 minutes to reduce the grain size to 3.5 $\mu$m and less. The mixture is then dried under reduced pressure and remixed in a pug mill because of the differences in specific gravity between the alloying components. At this point other additives used in compacting processes may be introduced.

The alloy powder that has been thus prepared can then be compacted in a mechanical, hydraulic or isostatic press. For pressing small shapes an easily-flowable powder is required. For this purpose the powder mixture which is as such ready for compacting is first granulated in special machines and simultaneously segregated for the required particle sizes on a screen. The size of the granules will depend upon the size of the compact that is to be pressed, and may be in the range from 0.08 to 0.5 mm.

The completed pressings are then sintered under a reduced pressure of less than $10^{-3}$ torrs at a temperature between 1350°and 1400°C exactly adjusted to ± 5°C of the required temperature according to the composition of the alloy.

After having been sintered the part may be machined in the heat-treated state to near the required final dimensions, as subsequent hardening, particularly in a hot hardening bath, produces practically no distortion, although a slight increase in volume may take place due to metallurgical structural changes that may occur, which slight increase in volume is sufficient for finish machining. Hardening is effected between 1000°and 1100°C, preferably between 1060°and 1070°C, from a protective gas-filled or vacuum furnace or a neutral salt bath, by quenching in oil at about 40°C. For hot bath hardening the parts are undercooled to 510°C from the same furnaces and the same temperatures, preferably in a neutral salt bath, final cooling being in still air. By such hardening processes, parts made of the alloy according to the invention have a hardness betwen 67 and 68 Rc. Tempering for from 1 to 4 hours at 500°to 520°C raises the hardness to between 70 and 72 Rc. It is a particular characteristic of the alloy according to the invention that the tempering temperature for achieving maximum hardness is 20°to 40°C below that of alloys lacking manganese, vanadium and niobium.

The following Examples of the invention are provided:

EXAMPLE 1

A tool liner was formed consisting of a sintered carbide hard alloy containing 34.5 % titanium carbide, the remainder being a steel matrix composed of 0.55 % carbon,
0.5 % copper,
0.1 % vanadium,
0.1 % niobium,
10.0 % chromium,
3.0 % molybdenum,
0.01 % boron,
balance iron The specific gravity of this alloy was between 6.45 and 6.5 g/cc, its compressive strength 350 to 400 kp/sq.mm, its elastic modulus 30,500 kp/sq.mm. and its coefficient of thermal expansion at 20°to 650°C 8.0 to 10.0 .$10^{-6}$ m/m. °C, its electric resistivity at 20°C being 0.69 ohm.mm²/m.

This alloy was hardened by quenching in oil from between 1050°and 1100°C to a hardness of 68 to 70 Rockwell. After tempering for 1 hour at 540°C the maximum hardness was increased to 70 to 72 Rockwell.

EXAMPLE 2

A tool liner was formed consisting of a sintered carbide hard alloy composed of 33 % by weight of titanium carbide in a steel matrix of the following composition:-

0.6 % carbon,
0.5 % copper,
16.5 % chromium,
1.2 % molybdenum,
0.5 % nickel,
0.01 % boron,
balance iron The specific gravity of this alloy was 6.4 g/cc., its compressive strength 380 kg/sq.mm., its elastic modulus 30,000 kg/sq.mm. and its coefficient of thermal expansion at 20°to 400°C 9.4 to 9.7 . $10^{-6}$ m/m. °C, its electrical resistivity at 20°C being 0.77 ohm.mm²/m.

After having been hardened by quenching from 1090°C in a hot bath of 510°C the alloy had a hardness of 68/69 Rockwell and after tempering for 2 hours at 540°C this remained at 66 to 68 Rc. After 50 hours service at 500°C the alloy still had a hardness of 66 Rc.

If the carbide hard alloys according to the invention are used for tool liners they can be highly prestressed when shrunk into steel rings at 650°C without loss of hardness. Since the compressive strength of the said carbide hard alloy is about 350 to 400 kp/sq.mm., the material can be strained to 0.8 % of its initial dimensions.

The carbide hard alloys according to the invention are extremely wear-resistant, even at higher temperatures, and can be machined in the heat-treated state. These properties make the said carbide hard alloys suitable as a material for the manufacture of any parts of machinery and engines in which high wear-resistance and hardness up to higher temperature levels are required. Particular uses are for liners for pressing dies, for example for dies for pressing bolts and nuts; warm (up to 580°C) and hot pressing dies (up to 1100°C) for pressing steel, aluminium, copper, other non-ferrous metals; engine and machinery parts, particularly sealing strips for rotary piston engines, piston rings, gaskets and seals for pumps of all kinds, plungers and pistons for pumps, mixer blades, sliding rails, templates and cams.

Sintered bodies produced from alloys according to the invention are dimensionally very stable and they have only a very thin sinter skin that can be easily removed to within very fine tolerations without expensive machining operations, simply by grinding. This is apparently due to the simultaneous presence of manganese, and on the presence of vanadium and niobium in the steel matrix of the said carbide hard alloys.

The alloys according to the invention may contain a high proportion of carbide particularly to between 50 and 80 % by weight, based on the alloy. Alloys having a carbide content as high as this cannot be machined by operations such as turning, milling, shaving and sawing, but they can be reduced to their final dimensions by grinding or by spark erosion and electrochemical machining techniques. The hardness of such alloys are related to the hardness of the metals from which they are formed, but if the steel matrix is heat-treated, they are still easier to machine than conventional hard metals. Another advantage of the alloys according to the invention over conventional naturally hard hard metals which are not hardenable, is their low specific gravity, which is about 5.4 to 5.6 g/cc.

Such alloys having a carbide content exceeding that of the steel matrix preferably contain 50% to 80% by weight of titanium carbide, and 20% to 50% by weight of a steel matrix consisting essentially of 0.4 to 0.8 % carbon,
8.0 to 15.0 % chromium,
2.0 to 3.5 % molybdenum,
0.6 to 1.6 % copper,
0.3 to 1.0 % vanadium and/or
0.05 to 0.2 % niobium,
0.001 to 0.01 % boron,
balance iron.

An example of such a preferred alloy is as follows:-

EXAMPLE 3

70% by weight of titanium carbide, and
30% by weight of a steel alloy containing
0.55 % carbon,
0.80 % copper,
10.0 % chromium,
3.0 % molybdenum,
1.0 % manganese,
0.5 % vanadium,
0.01 % boron,
balance iron.

After mixing, grinding, pressing and sintering for instance in a vacuum that is greater than $10^{-2}$ torrs at a temperature of 1390°C, the said alloy has a specific gravity of 5.45 to 5.55 g/cc.

Although the alloy is naturally hard, i.e. like a hard metal it cannot be machined except by grinding or as hereinbefore described, its hardness and wear resistance can be further raised by a heat treatment, the steel matrix changing its structure according to the nature of the said heat treatment. By heating for 2 hours at 1000°C and 4 hours at 720°C a hardness of 71 to 72 Rc is achieved, the titanium carbides being embedded in a ferriticpearlitic matrix.

Hardening this alloy in air, i.e cooling in air after 1 hour's austenisation at 1070°C, results in a martensitic structure and an improvement of its hardness to values between 76 and 78 Rc, as well as of its antifriction properties.

By tempering for 2 hours at 520°C the high temperature strength of the alloy can be improved without loss of hardness.

What is claimed is:

1. A sintered steel-bonded carbide hard alloy, comprising from 15% to 80% by weight of a carbide of at least one metal selected from the class consisting of chromium, molybdenum, tungsten, tantalum, niobium, zirconium and titanium and from 20% to 85% by weight of a steel matrix consisting essentially of
0.25 to 0.9 % carbon,
5 to 18.0 % chromium,
2 to 5.0 % molybdenum,
0.3 to 3.0 % copper,
0.1 to 1.0 % vanadium,
0 to 3.0 % manganese,
0 to 1.0 % silicon,
0 to 6.0 % cobalt,
0 to 0.5 % niobium,
0 to 0.01 % boron,
0 to 1.8 % nickel,
balance iron.

2. A sintered alloy according to claim 1, wherein the manganese content of the steel matrix is from 0.8 % to 1.9%.

3. A sintered steel-bonded carbide hard alloy, comprising from 32% to 35% by weight of titanium carbide and from 65% to 68% by weight of a steel matrix consisting essentially of
0.4 to 0.6 % carbon,
8.0 to 12.0 % chromium,
2.5 to 4.0 % molybdenum,
0.3 to 0.8 % copper,
0.001 to 0.01 % boron,
0.1 to 0.3 % vanadium,
0.1 to 0.3 % niobium,
balance iron.

4. A sintered steel-bonded carbide hard alloy comprising about 33% by weight of titanium carbide and about 67% by weight of a steel matrix consisting essentially of
0.6 % carbon,
0.5 % copper,
16.5 % chromium,
1.2 % molybdenum,
0.5 % nickel,
0.01 % boron,
balance iron.

5. A sintered steel-bonded carbide hard alloy comprising 32% to 35% by weight of titanium carbide and 65% to 68% of a steel matrix consisting essentially of
0.4 to 0.6 % carbon,
0.9 to 1.2 % manganese,
0.9 to 1.2 % copper,
0.1 to 0.5 vanadium,
8.0 to 12.0 % chromium,
2.5 to 4.0 % molybdenum,
0.1 to 0.25 % niobium,
0.008 to 0.01 % boron,
balance iron.

6. A sintered steel-bonded carbide hard alloy comprising 50% to 80% by weight of titanium carbide and 20% to 50% by weight of a steel matrix consisting essentially of
0.4 to 0.8 % carbon,
8.0 to 15.0 % chromium,
2.0 to 3.5 % molybdenum,
0.6 to 1.6 % copper,
0.3 to 1.0 % vanadium and/or
0.05 to 0.2 % niobium,
0.001 to 0.01 % boron,
balance iron.

7. a sintered steel-bonded carbide hard alloy comprising about 70% by weight of titanium carbide and about 30% by weight of a steel alloy consisting essentially of
0.55 % carbon,
0.80 % copper,
10.0 % chromium,
3.0 % molybdenum,
1.0 % manganese,
0.5 % vanadium,
0.01 % boron,
balance iron.

* * * * *